US006756566B2

(12) United States Patent
Moller

(10) Patent No.: US 6,756,566 B2
(45) Date of Patent: Jun. 29, 2004

(54) CONVECTION HEATING SYSTEM FOR VACUUM FURNACES

(75) Inventor: Craig A. Moller, Roscoe, IL (US)

(73) Assignee: Ipsen International, Inc., Cherry Valley, IL (US)

( * ) Notice: Subject to any disclaimer, the term of this patent is extended or adjusted under 35 U.S.C. 154(b) by 0 days.

(21) Appl. No.: 10/154,457

(22) Filed: May 23, 2002

(65) Prior Publication Data

US 2002/0195439 A1 Dec. 26, 2002

Related U.S. Application Data

(63) Continuation-in-part of application No. 09/597,496, filed on Jun. 20, 2000, now Pat. No. 6,533,991.

(51) Int. Cl.[7] ..... F27D 11/00

(52) U.S. Cl. ..... 219/400; 219/390; 219/411; 392/416; 392/418; 118/724; 118/725; 118/50.1; 266/217; 266/249; 266/250; 266/270

(58) Field of Search ..... 219/390, 400, 219/405, 411; 392/416, 418; 118/724, 725, 50.1; 266/217, 249, 250, 266, 270

(56) References Cited

U.S. PATENT DOCUMENTS 2,734,738 A * 2/1956 Even ..... 266/266
4,285,504 A 8/1981 Colvin
4,610,435 A * 9/1986 Pfau et al. ..... 266/250

OTHER PUBLICATIONS

Technical data, Seco/Warwick, Jun. 2001.
Technical data, Abar Ipsen.
Technical data, VFS, Sep. 1998.

* cited by examiner

*Primary Examiner*—Shawntina Fuqua
(74) *Attorney, Agent, or Firm*—Dann, Dorfman, Herrrell and Kellman, P.C.

(57) ABSTRACT

A convection heating system includes a hot zone enclosure defining a hot zone and a plurality of gas injection nozzles for injecting a cooling gas into the heat treatment zone of furnace. Each gas injection nozzle may include a flap disposed and pivotally supported therein for substantially preventing the escape of heat from the hot zone during a heating cycle, but for permitting the injection of the cooling gas into the furnace hot zone during a cooling cycle. A gas exit port may be provided and may include a flap pivotally mounted therein for impeding the unforced outward flow of a gas from the heat treatment zone during a heating cycle.

11 Claims, 8 Drawing Sheets

CONVECTION HEATING SYSTEM FOR VACUUM FURNACES

This application is a continuation-in-part of application Ser. No. 09/597,496 filed on Jun. 20, 2000, now U.S. Pat. No. 6,533,991 the disclosure of which is incorporated herein by reference.

FIELD OF THE INVENTION

This invention relates generally to vacuum heat treating furnaces, and in particular, to a convection heating system for vacuum furnaces having a unique combination of features that provides significantly improved heat retention and heat transfer during heating and cooling cycles, respectively.

BACKGROUND OF THE INVENTION

Known vacuum heat treating furnaces available hitherto incorporate cooling gas injection systems to provide cooling of metal parts from the elevated heat treatment temperature. Among the components of the cooling gas injection system used in such furnaces are a plurality of nozzles for conducting the cooling gas into the furnace hot zone. The gas injection nozzles used in the known systems are generally tubular or cylindrical in shape and have an unobstructed central opening that extends along the length of the nozzle.

A problem arises when using such nozzles in a vacuum heat treating furnace. Because the known nozzles have unobstructed openings therethrough, heat can be lost from the hot zone during the heating cycle. Such heat loss occurs when the heated atmosphere in the furnace hot zone escapes the hot zone through the cooling gas nozzles and is cooled in the plenum or, in a plenumless furnace, in the space between the hot zone and the furnace wall. The heated gas is cooled as it traverses the plenum, or the annular space between the hot zone and the water-cooled furnace wall in a plenumless furnace, and reenters the hot zone at a lower temperature. This problem occurs in vacuum furnaces that utilize convection heating.

In addition, in the known vacuum heat treating furnaces with forced gas cooling, a return path is provided so that the cooling gas can be recirculated and cooled. This return path usually includes an opening in the hot zone enclosure so that the cooling gas can exit the hot zone. This opening in the hot zone wall also permits heat to escape from the hot zone during heating.

The above-described heat loss results in a non-uniform heating of the metal parts and higher energy use. When the metal parts do not uniformly attain the desired heat treating temperature, the properties desired from the parts are not achieved. Consequently, a need has arisen for a heat treating furnace having a forced gas cooling function which substantially prevents the heat in the hot zone from exiting the hot zone during a convection or other heating cycle. It would be highly desirable to have a simple device for injecting cooling gas into a vacuum heat treating furnace which substantially inhibits the escape of heated gas therethrough without the need for actuators and the mechanical linkage systems needed to operate such actuators.

SUMMARY OF THE INVENTION

In accordance with the present invention, a heat treatment furnace having forced gas cooling or quenching capability is provided. The heat treatment furnace according to this invention includes an outer furnace wall inside of which a heat shielded enclosure is provided. The heat shielded enclosure contains an interior space, or hot zone, in which a work piece may be placed/positioned for heat treatment. The enclosure is designed with substantial thermal insulation to impede the outward flow of heat from the hot zone. The enclosure includes a plurality of orifices disposed in a selected area or areas of the enclosure wall. A plurality of nozzles are provided in communication with the orifices so that a cooling gas may be injected into the hot zone through the nozzles during a cooling cycle. The nozzles include a flow control means that is adapted for allowing an inward flow of the cooling gas during a cooling cycle, but which impedes the outward flow of heat from the hot zone during a heating cycle. In a first embodiment of the flow control means, each nozzle includes a flap disposed in a channel formed through the nozzles. The flap is pivotally supported in the channel in such a manner so as to impede the outward flow of heat from the hot zone, but to permit the inward flow of the cooling gas. The furnace further includes a gas exit port disposed in a wall of the heat shielded enclosure. The gas exit port provides a passageway through which the cooling gas introduced into the hot zone via the nozzles may exit the hot zone for recirculation and cooling . The gas exit port is also configured to impede the outward flow of heat from the hot zone during a heating cycle of the furnace. In a preferred embodiment of the gas exit port, the exit port includes a pivotally mounted panel in the passageway for impeding the unforced outward flow of heat from the hot zone. The exit port panel also functions to prevent the unforced introduction of cooler gas into the hot zone. A gas circulation means is also provided within the heat shielded enclosure for providing stirring circulation of the heated atmosphere within the hot zone to convectively heat or cool a work piece that is being heat treated in the furnace. The circulation means may conveniently be provided as a fan.

BRIEF DESCRIPTION OF THE DRAWINGS

The foregoing summary, as well as the following detailed description of a preferred embodiment of the present invention, will be better understood when read in conjunction with the drawings, in which.

DETAILED DESCRIPTION

Figure 1:
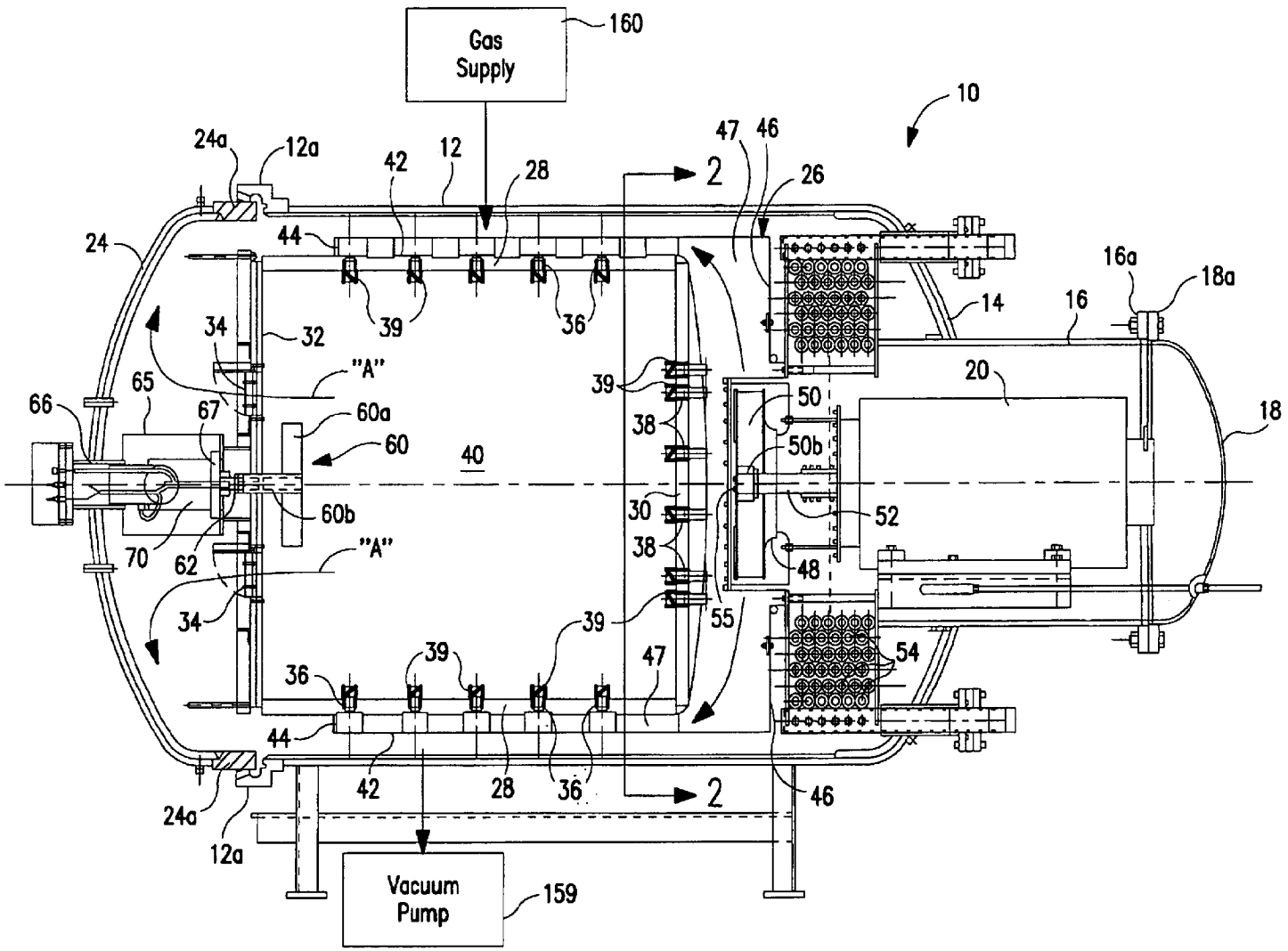
FIG. 1 is a schematic view partially in section of a vacuum heat treating furnace in accordance with the present invention.

Referring now to the drawings wherein like reference numerals refer to the same or similar elements across the several views, and in particular to FIG. 1, there is shown a heat treating furnace generally designated 10 which includes a pressure vessel having a double outer wall 12, preferably of generally cylindrical shape, and a domed double end wall 14. The space between the double walls can be insulating space to impede the flow of heat or can be liquid filled and used as a cooling jacket, if desired. End wall 14 includes a cylindrical motor housing and support 16 which has a flanged outer edge 16*a* which mates with a flanged edge 18*a* of an end closure 18 for the motor housing. End closure 18 is removable for servicing the motor 20. Although not shown here, the flanges are provided with suitable fastening means (e.g., bolts) and sealing means (e.g., gasket seal). A motor 20 is supported within the housing 16 and is provided with electrical connections which pass through motor housing wall 16 in a sealed manner.

Figure 2:
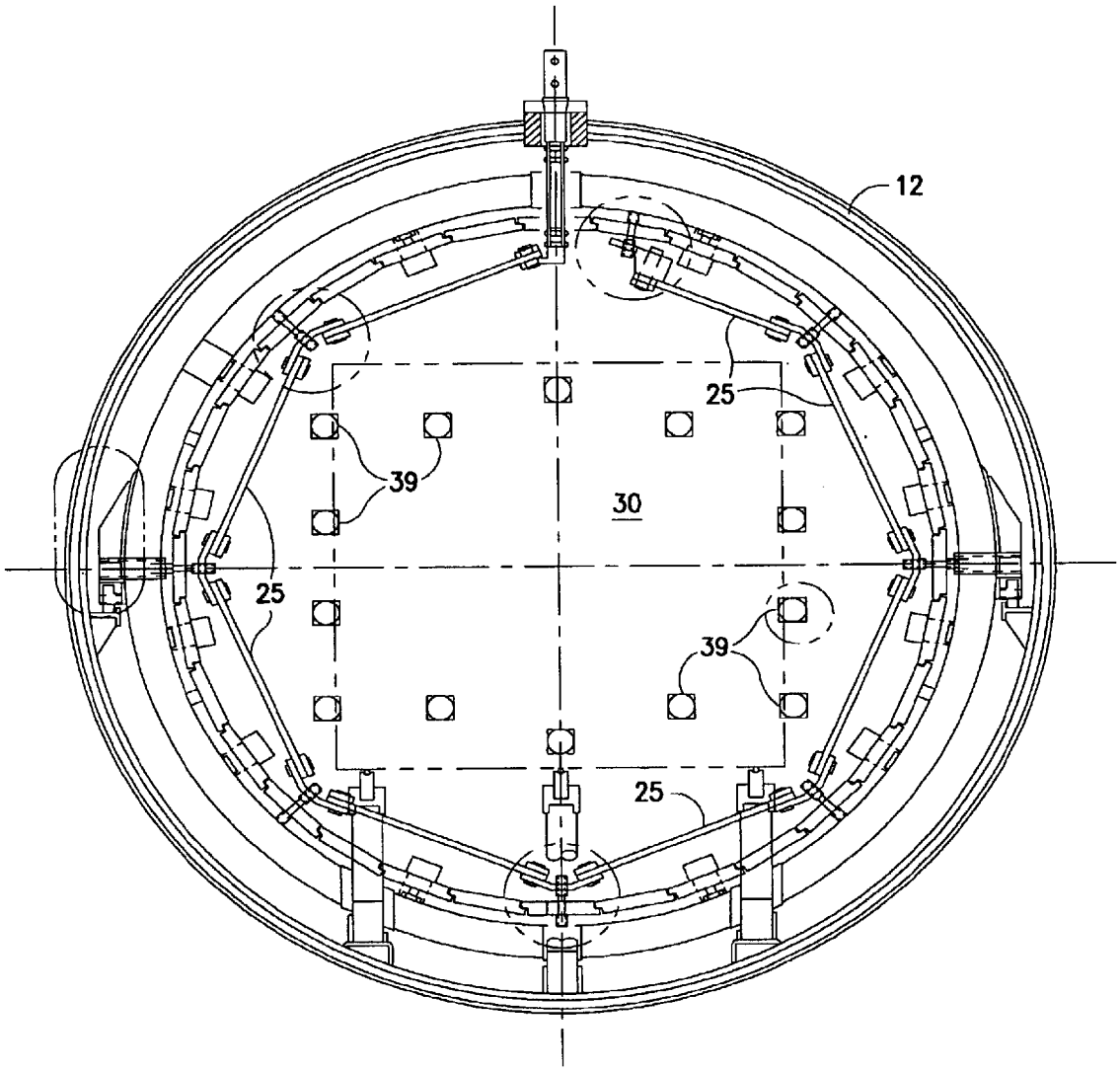
FIG. 2 is a sectional view taken along line 2—2 of FIG. 1 showing the end wall of the heat shielded enclosure.
Figure 3:
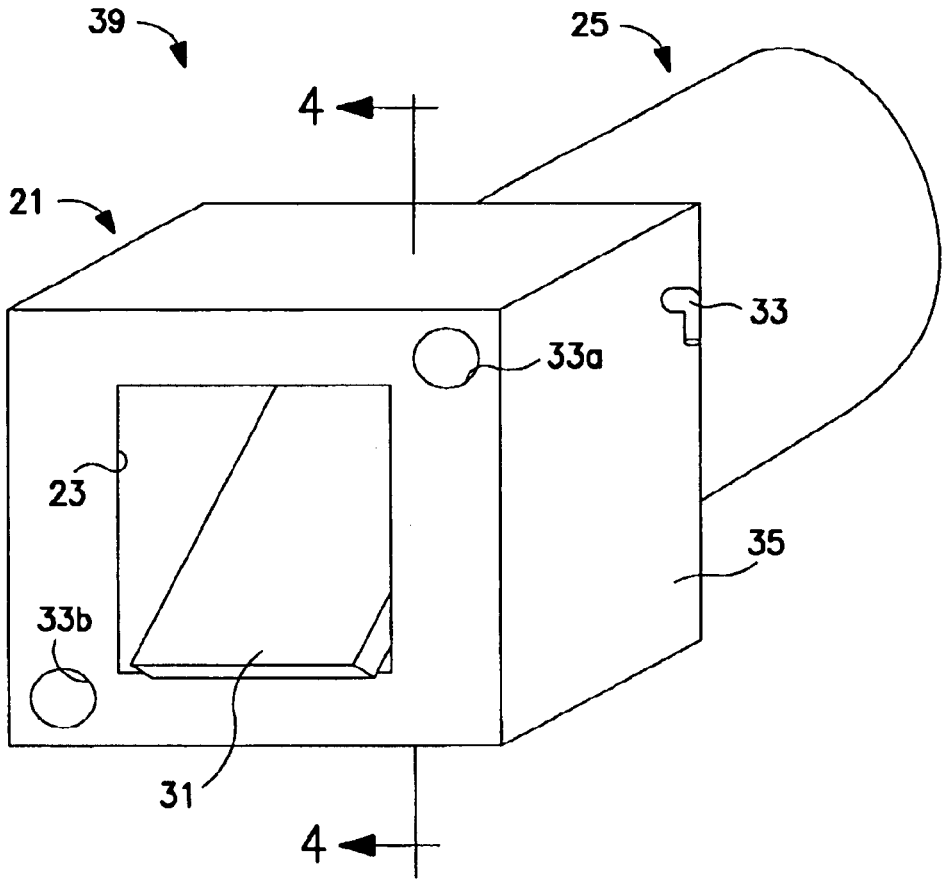
FIG. 3 is a perspective view of a cooling gas nozzle in accordance with the present invention.

The opposite end of the vacuum furnace 10 is provided with a double-wall end closure 24 having a sealing flange 24*a* which cooperates with a sealing flange 12*a* on the cylindrical double wall structure 12. A furnace of the present invention may vary in size, but is typically quite large, having a diameter of perhaps six feet or more. In such large structures the end closure 24 is supported in a way not material to the present invention, but which enables it to be conveniently moved away from the end of the structure to allow the introduction into the furnace hot zone of work pieces to be heat treated, typically supported on refractory pallets. Although not shown the furnace requires heating elements 25 or other means of heating. One such heating element arrangement is shown in FIG. 2.

As shown in FIG. 1, a heat shielded enclosure, or hot zone wall, generally designated 26, conforming to the shape of the outer wall 12 is suitably supported in the pressure vessel by structure not shown, but well known in the art. In a cylindrical furnace, such as that shown in the drawings, a cylindrical hot zone wall 28 is preferably generally arranged coaxially with the longitudinal axis of the pressure vessel. The hot zone wall 28 is spaced inwardly a uniform spacing distance from the outer furnace wall 12. In the embodiment shown in FIG. 1, the hot zone enclosure 26 is substantially cylindrical. However, the enclosure 26 and hot zone wall 28 may have other cross-sectional shapes such as square, rectangular, or polygonal, as needed for a particular application. The hot zone enclosure 26 is lined internally with a refractory material to resist the intense processing heat. The hot zone enclosure 26 is designed to retain the heat within the enclosure and impede its flow outwardly and to provide a hot zone 40 therein into which work pieces to be heat treated are positioned.

An end wall 30 of construction similar to the hot zone wall 28, is attached at one end thereof. A movable end wall 32 is disposed at the opposite end of the heat shielded enclosure 26, and is of similar construction thereto. End wall 32 is dimensioned to substantially close the open end of the enclosure 26. The movable wall 32 which completes the heat shielded enclosure 26 is affixed to and moves with the furnace end closure 24. End closure 24 includes a cylindrical motor housing 65 and support 66. The motor housing 65 is generally cylindrical in shape and has a central longitudinal axis substantially aligned with the central longitudinal axis of the enclosure 26 when the movable end wall 32 is engaged to close the open end of the enclosure 26. A convection motor 70 is supported within the housing 65 on support structure 67. The convection motor 70 is provided with electrical connections 68 which pass through and are sealed at motor housing wall. The convection motor 70 is also provided with optional water cooling by means of inlet water tubing 64*a* and outlet water tubing 64*b* which pass through and are sealed at the motor housing wall.

Figure 1A:
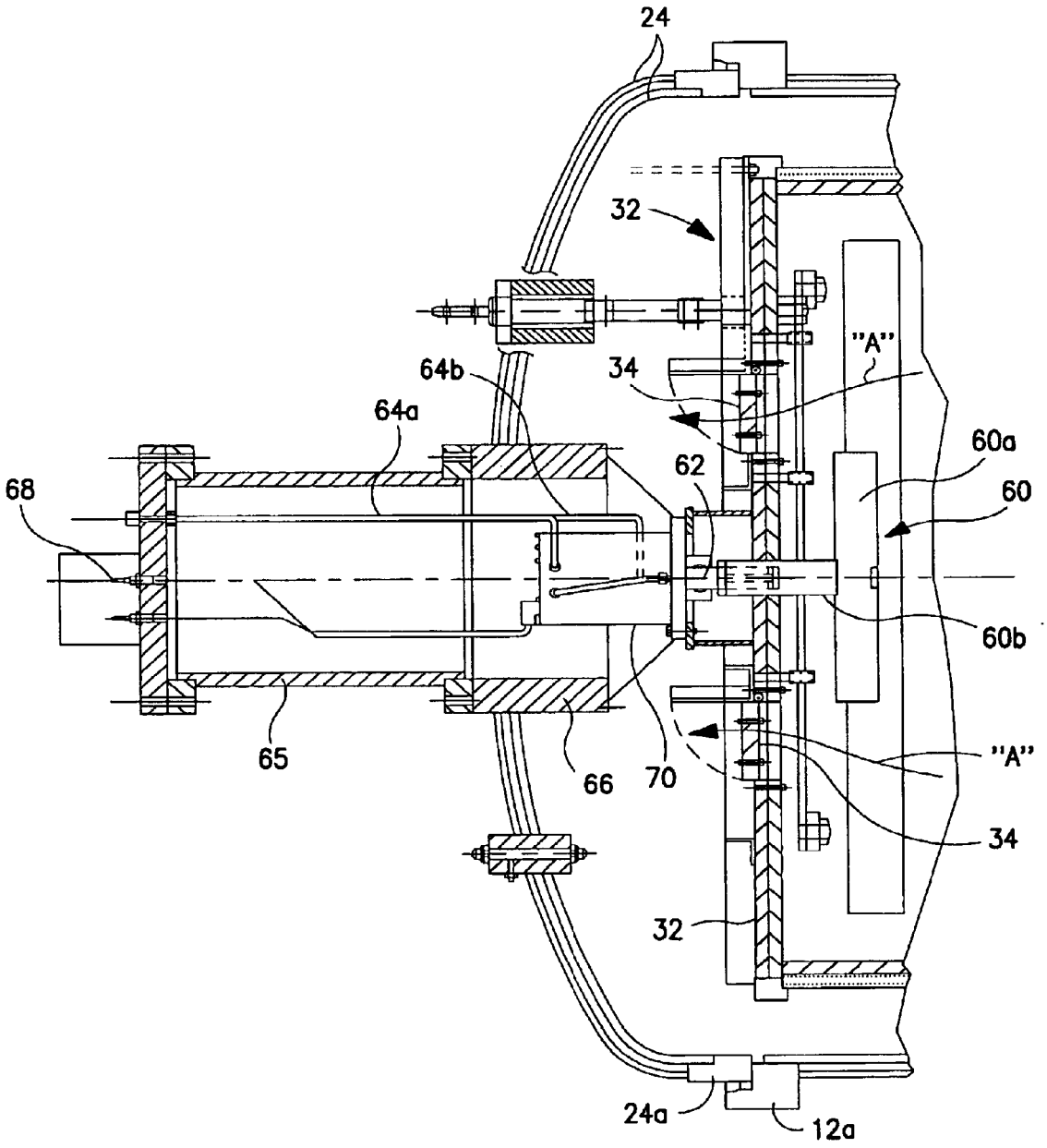
FIG. 1A is a detail view of an alternative arrangement for the end wall structure of the vacuum heat treating furnace shown in FIG. 1.

A convection fan 60 is attached to a hub 60*b*, which is mounted to the shaft 62 of the convection motor 70. The hub 60*b* extends through an aperture in the movable end wall 32 so that the fan 60 is located inside the hot zone when the end closure 24 and end wall 32 are in the fully closed position. The convection fan 60 in the embodiment shown in FIGS. 1 and 1A has flat blades 60*a* attached to the hub 60*b* on the shaft 62. Because the blades 60*a*, hub 60*b*, and shaft 62 are disposed within the hot zone 40 during the heating cycle of the furnace 10, those components are preferably made of a refractory material capable of withstanding the very high temperatures attained within the hot zone 40. One such suitable material is carbon reinforced carbon (CFC) manufactured by C-CAT, Inc. of Fort Worth, Tex., USA. In operation, the convection fan 60 circulates or stirs the gas within the hot zone 40 during a convection heating cycle to provide more rapid and uniform heating of work pieces present within the hot zone 40. In addition, during a cooling cycle the convection fan 60 may be used to assist circulation of the cooling gas within the hot zone 40 to provide more rapid and uniform cooling of the work pieces.

The hot zone wall 28 of the heat shielded enclosure 26 is perforated with a plurality of orifices 36. Optionally, a plurality of orifices 38 perforate the end wall 30 also. The orifices 36, 38 are so distributed over the wall areas as to permit the flow of cooling or heat treating gas in several directions in the hot zone 40, toward the work pieces being treated. The orifices 36, 38 may have any shape and pattern of distribution at the enclosure wall 28 and end wall 30 that is suited to provide the desired flow of gas into the hot zone 40. For example, the orifices 36, 38 may comprise a series of holes in the walls 28, 30. Alternatively, the orifices 36, 38 may comprise one or more longitudinal slots.

A plurality of gas injection nozzles 39 are disposed in communication with the orifices 36, 38 to provide a means for injecting a cooling gas into the hot zone 40 during a forced gas cooling cycle of the heat treating furnace when the work pieces are rapidly cooled from the heat treating temperature. The gas injection nozzles 39 include a means for substantially preventing the egress of heat from the hot zone 40 during the heating cycle of the furnace 10. The gas injection nozzles 39 may comprise any structure that permits the forced flow of gas therethrough, but which also impedes the flow of heat that would otherwise be induced by natural convection therethrough. For example, the nozzles 39 may comprise a baffle structure in gaseous communication with the orifices 36, 38. In a preferred embodiment, the nozzles 39 have a flap valve which is described more fully hereinbelow.

Figure 6:
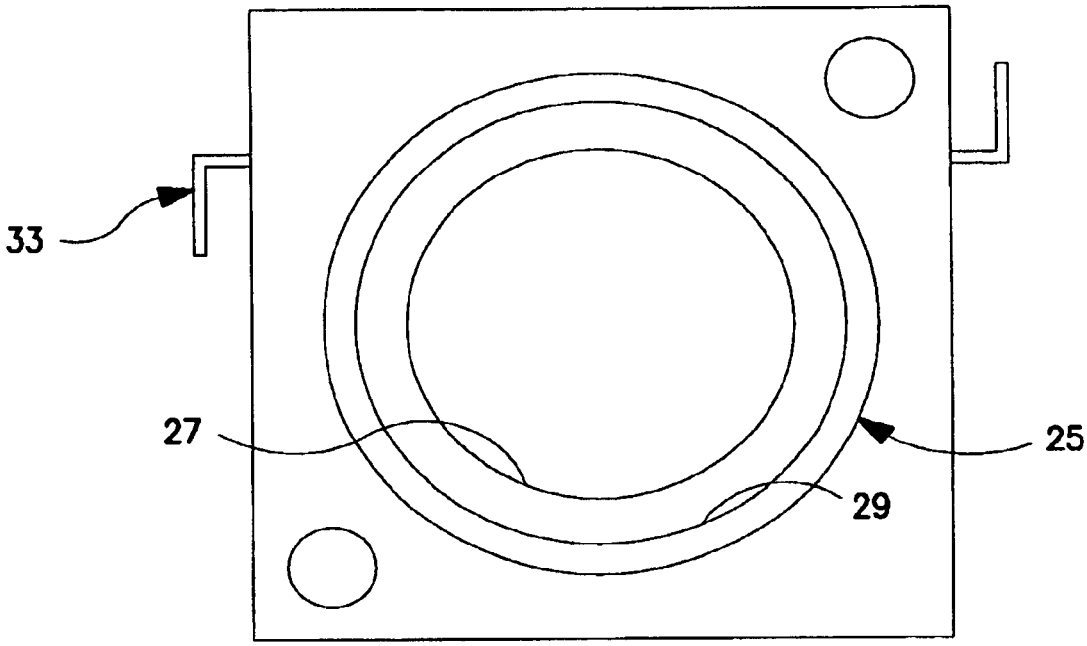
FIG. 6 is a rear elevation view of the cooling gas nozzle of FIG. 3.

The gas injection nozzles 39 are fastened to the hot zone wall 28 by any appropriate means. This arrangement can be seen more easily in FIG. 6. Suitable fastening means include pins, bolts, wires, threads, twist-lock tabs, or retaining clips. The means for attaching the nozzle 39 to the hot zone wall 28 preferably provides for easy installation and removal of the nozzle 39 to facilitate assembly and maintenance of the heat treating furnace 10 and/or its heat shielded enclosure 26. A preferred means for attaching the nozzle 39 to the hot zone wall 28 is described more fully below.

Figure 4:
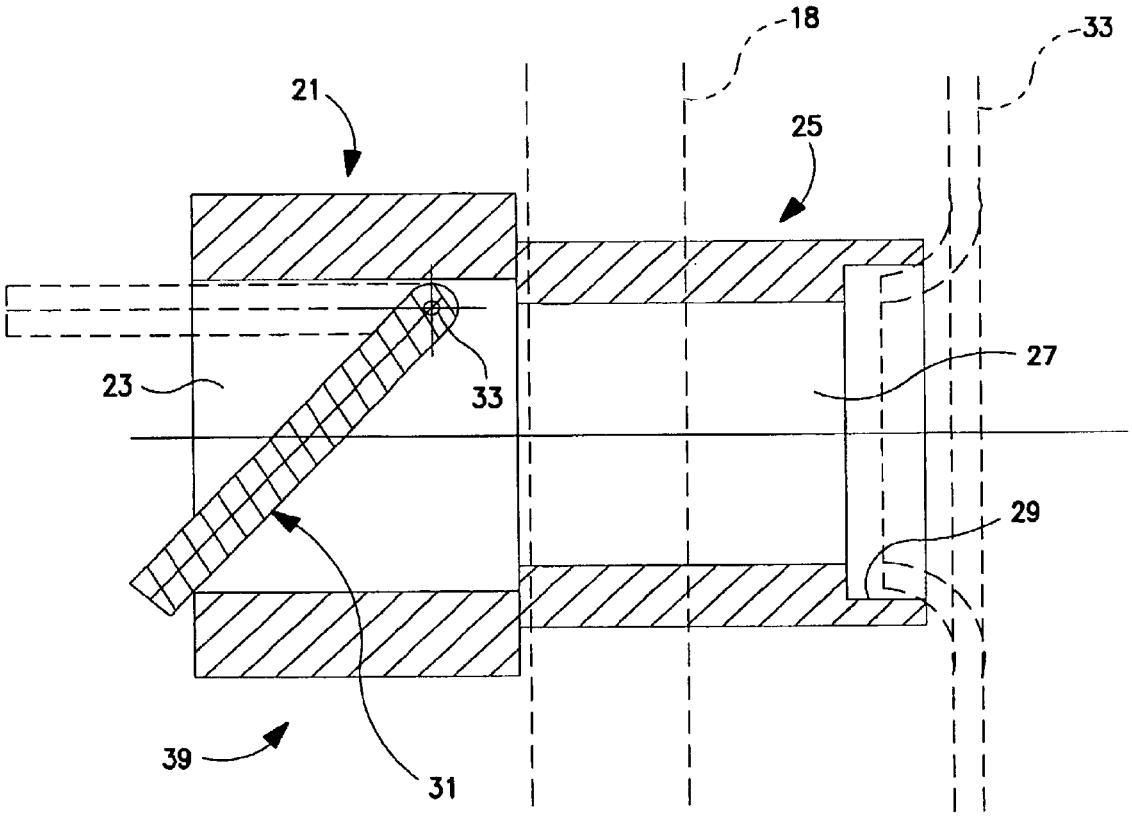
FIG. 4 is a cross-sectional side elevation view of the cooling gas nozzle of FIG. 3 as viewed along line 4—4 therein.

Referring now to FIGS. 3–7, an embodiment of the gas injection nozzle 39 will be described in greater detail. The gas injection nozzle 39 is formed of a forward portion 21 which is exposed in the hot zone 40 and a rear portion 25 which is attached to the hot zone wall 28 and end wall 30 to communicate with orifices 36 and orifices 38, respectively. A first central opening 23 is formed through the length of the forward portion 21 and a second central opening 27 is formed through the length of the rear portion 25. The first central opening 23 and the second central opening 27 are aligned to form a continuous channel through the nozzle 39. The rear portion 25 has an annular recess 29 formed at the end thereof. The annular recess 29 is formed to accommodate a boss on the hot zone wall 28 around the orifice 36 as shown in FIG. 4.

Figure 7:
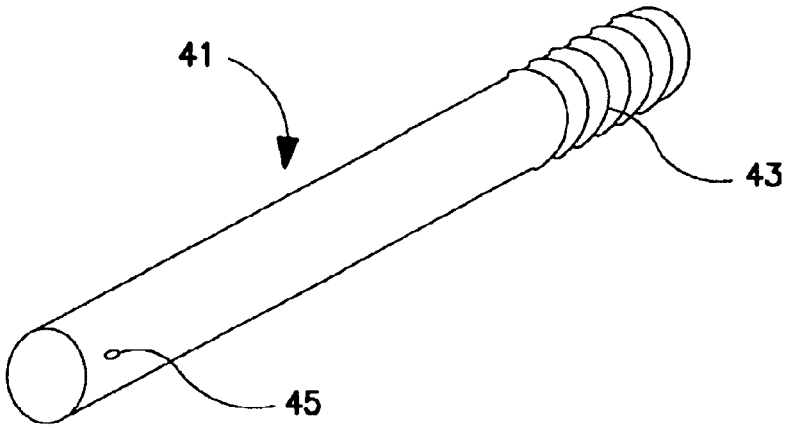
FIG. 7 is a perspective view of a pin for attaching the cooling gas nozzle of FIG. 3 to a furnace hot zone wall.
Figure 5:
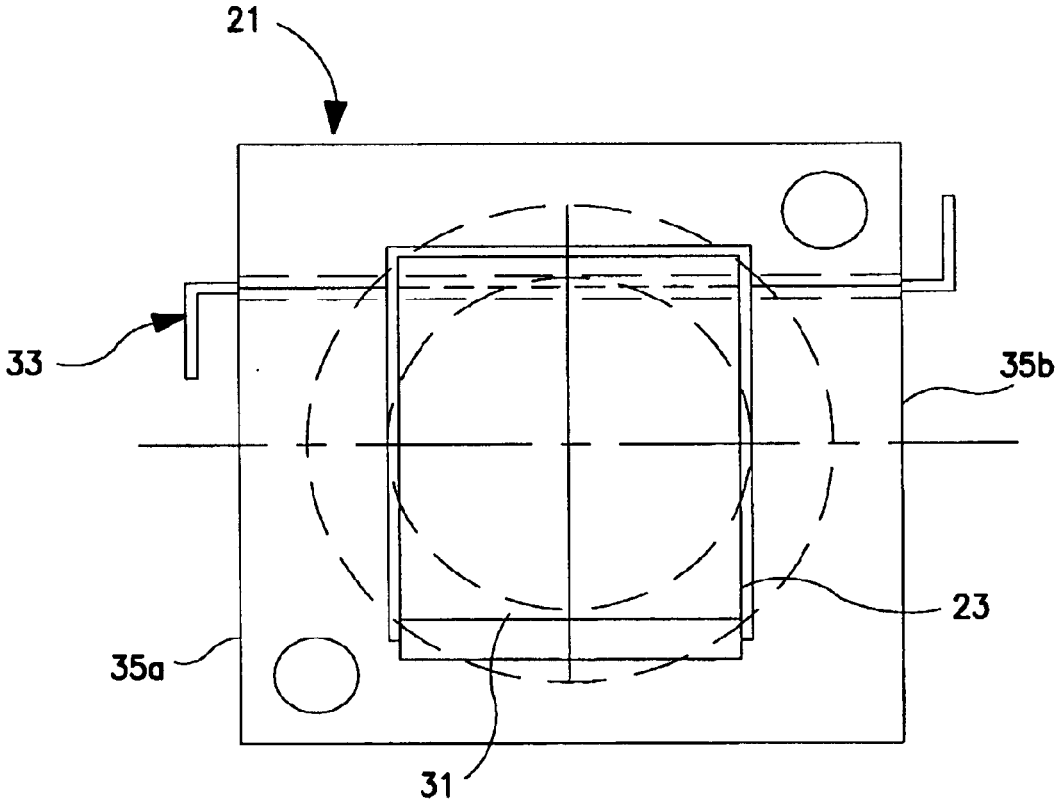
FIG. 5 is a front elevation view of the cooling gas nozzle of FIG. 3.

A pair of boreholes 33*a* and 33*b* are formed or machined in the nozzle 39 for receiving metal attachment pins that attach the nozzle 39 to the hot zone wall 28. A preferred construction for the attachment pins is shown in FIG. 7. A pin 41 has a first end on which a plurality of screw threads 43 are formed to permit the pin 41 to be threaded into a threaded hole (not shown) in the hot zone wall. It will be appreciated that instead of the screw threads 43, the first end of pin 41 can be provided with twist-lock tabs, or a transverse hole for accommodating a retaining clip. The other end of the attachment pin 41 has a transverse hole 45 formed therethrough for receiving a retaining clip (not shown) to hold the nozzle 39 in place.

A flap 31 is disposed in the first central opening 23 and is pivotally supported therein by a pin 33 which traverses holes in the sidewalls 35*a*, 35*b* of forward portion 21. The flap 31 is positioned and dimensioned so as to close the central opening 23 when it is in a first position, thereby preventing, or at least substantially limiting, the transfer of heat out of the hot zone 40 and the unforced introduction of cooler gas into the hot zone through the central channel of the nozzle 39. In a second position of the flap, as shown in phantom in FIG. 4, the central opening 23 is open to permit the forced flow of cooling gas therethrough into the hot zone 40 during a cooling or quenching cycle. For simplicity, the flap 31 is maintained in the first or closed position by the force of gravity. In such an arrangement the nozzle 39 is preferably oriented such that the flap will be normally closed. In a horizontally oriented vacuum furnace, as shown in the embodiment of FIG. 1, some of the nozzles 39 in the upper half of the hot zone 40 will necessarily be open a small amount because of the orientation of the nozzles 39 and the effect of gravity on the flap 31. When it is desired to maintain the flaps 31 of such nozzles 39 in the normally closed position, biasing means, such as a counterweight or a spring, can be used. The biasing means should provide sufficient biasing force to maintain the flap 31 in the normally closed position, but the biasing force of the biasing means should be less than the force of the cooling gas on the flap 31 when it is being injected so that the flap 31 can be readily moved to the open position by the flow of the cooling gas.

The nozzle 39 and the flap 31 are preferably formed from a refractory material such as molybdenum, graphite, or CFC. They may also be formed of a ceramic material if desired. In the embodiment shown, the forward portion 21 is rectangular in cross section and the rear portion 25 is circular in cross section. However, the shapes of the forward and rear portions of nozzle 39 are not critical. Similarly, the shapes of the first and second central openings 23, 27 are not critical. The first central opening 23 is preferably square or rectangular for ease of fabrication and the second central opening 27 is preferably circular for ease of adaptation with the opening in the hot zone wall 28.

Referring back now to FIG. 1, cooling gas is preferably supplied to the nozzles 39 through a plenum 47. Accordingly, the orifices 36, 38 are provided over an area of the enclosure wall 28 and end wall 30 selected to provide passageways for gaseous communication between the hot zone 40 and the plenum 47. The plenum 47 is disposed in the passage between the furnace wall 12 and the enclosure wall 28 and extends around the back thereof, over the orifices 36, 38. The plenum 47 includes a plenum wall 42 connected to the heat shielded enclosure wall 28 by radially inwardly extending plenum end wall 44 located between the orifices 36 and the open end 37 of the enclosure 26 to provide an annular flow channel around the hot zone wall 28. The plenum wall 42 extends beyond the end wall 30 of the heat shielded enclosure 26 and the plenum 47 is continued by a planar plenum end wall 46 extending radially inwardly to a cowling 48. A blower fan 50 is attached at hub 50*b* to shaft 52 of motor 20. In the embodiment shown in FIG. 1, a heat shield 55 is mounted between the fan 50 and hot zone enclosure 26 in order to protect the fan and motor from the intense heat generated in the hot zone 40 during operation of the furnace. The cowling 48 has a curved or flared entry throat to minimize turbulence and promote efficient flow of the cooling gas from the blower fan 50. The fan in the embodiment shown in FIG. 1 preferably has curved blades. The outward flow of air from blower fan 50 is directed in a generally radial direction throughout 360° in the space defined by the plenum 47. The plenum 47 itself is adapted to handle the pressure and to keep the gaseous atmosphere relatively confined so as to cause relatively even flow through the nozzles 39 into the not zone 40. Heat exchange coils 54 are preferably disposed in the recirculation channel between walls 46 and 14 to cool the recirculated cooling gas. Whether the coils are wound in helical layers as suggested in FIG. 1 is a matter of choice. The actual configuration of coils is not critical and may be varied a great deal.

During a cooling cycle, the cooling gas, after entering the hot zone 40, flows out of the hot zone 40 and into a coolant recirculation channel through the gas exit ports 34 as shown by the arrows "A". The gas exit ports 34 may be provided in one or more of the movable end wall 32, enclosure wall 28, and end wall 30. In the embodiments shown in FIGS. 1 and 1A, the gas exit ports are provided in the movable end wall 32. The recirculation channel is defined by the furnace wall 12 and the outer plenum wall 42 and by the walls 46 and 14. The gas exit ports 34 may comprise any structure that permits the forced flow of gas therethrough and also prevents the flow of heated gas therethrough that is induced by natural convection.

Figure 8:
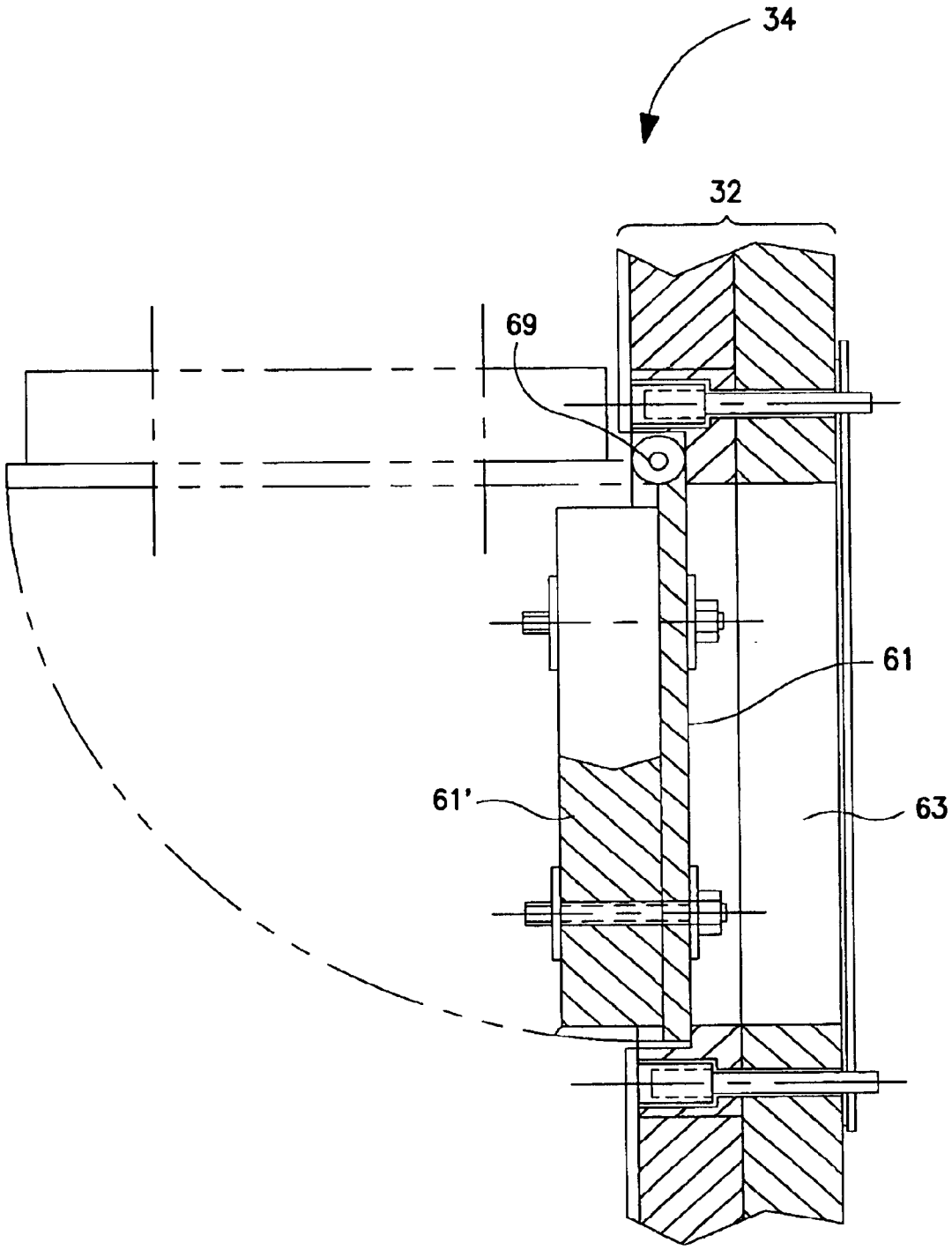
FIG. 8 is a cross-sectional side elevation view of a gas exit port in accordance with the present invention.

A preferred arrangement of the gas exit port 34 is shown in FIG. 8. The gas exit port 34 comprises an exit port panel or flap 61 similar in function to the flap 31 of a nozzle 39. The exit port flap 61 is disposed in exit port opening 63 which is formed in the movable end wall 32. The exit port flap 61 is pivotally supported within the exit port opening 63 by a pin 69 which is held within the movable end wall 32. The exit port flap 61 is positioned and dimensioned so as to close the exit port opening 63 when the flap is in a first position, thereby preventing, or at least substantially limiting, the transfer of heat out of the hot zone 40 and preventing the unforced introduction of cooler gas into the hot zone 40 through the exit port opening 63. To enhance this function, the flap 61 is lined with thermal insulation 61. In a second position of the flap 61, as shown in phantom, the exit port opening 63 is open to permit the forced flow of cooling gas therethrough from the hot zone 40 during a cooling or quenching cycle. For simplicity, the exit port flap 61 is maintained in the first or closed position by the force of gravity. In such an arrangement the exit port flap 61 is preferably oriented such that it will be normally closed. The exit port flap 61 is preferably formed from a refractory material such as molybdenum, graphite, or CFC. The exit port flap 61 may also be formed of a ceramic material if desired. The shapes of the exit port opening 63 and exit port flap 61 are not critical. The exit port opening 63 and exit port flap 61 are preferably square or rectangular for ease of fabrication.

Referring back to FIG. 1, a vacuum pump, shown schematically as block 159, is provided for evacuating the furnace chamber. A controlled pressure gas supply 160 is also provided to introduce the processing gas into the furnace chamber. The processing gas is typically introduced at pressures elevated substantially above atmospheric pressure. Separate fluid supply and circulating means may be provided to supply coolant fluid to the furnace jacket 12, 14 and the end enclosure 24 and to the heat exchanger coils 54, as needed.

It will be recognized by those skilled in the art that changes or modifications may be made to the above described embodiments without departing from the broad, inventive concepts of the invention. It is understood, therefore, that the invention is not limited to the particular embodiment(s) disclosed, but is intended to cover all modifications and changes which are within the scope and spirit of the invention as defined in the appended claims. For example, the convection heating system according to this invention can be used in a vacuum heat treating furnace in which the cooling fan and heat exchanger coils are external to the furnace vessel.

What is claimed is:

1. A heat treatment furnace having gas cooling or quenching capability comprising:

an outer furnace wall;

a heat shielded enclosure surrounding a heat treatment zone within the outer furnace wall, said enclosure being designed to retain heat within the zone and impede its outward flow therefrom, said enclosure having a plurality of orifices formed therein; and a plurality of nozzles, each in communication with one of said orifices, for injecting a cooling gas into the heat treatment zone, each of said nozzles including a flow control means for impeding unforced flow of heated gas from the heat treatment zone, said flow control means movable to an open position in response to a forced inward flow of gas to the heat treatment zone to permit the inflow of gas through the nozzle into the heat treatment zone.

2. The heat treatment furnace according to claim 1 wherein the nozzles each comprise:

a channel formed therethrough;

a flap disposed in the channel for impeding the outward flow of a heated gas from the heat treatment zone; and means for pivotally supporting said flap in said channel.

3. The heat treatment furnace according to claim 1, comprising a gas exit port disposed in a wall of the heat shielded enclosure, said gas exit port comprising a flow control means for impeding unforced outward flow of the heated gas from the heat treatment zone, said exit port flow control means movable to an open position in response to a forced outward flow of gas from the heat treatment zone to permit the outward flow of gas from the heat treatment zone.

4. The heat treatment furnace according to claim 1 comprising a gas circulation means for providing circulation of a processing gas within the heat treatment zone to convectively heat or cool a work piece in the heat treatment zone.

5. The heat treatment furnace according to claim 1 wherein the gas circulation means comprises a fan and a motor operatively coupled to said fan for driving said fun, wherein said fan is disposed in said heat treatment zone and said motor is mounted to said outer furnace wall externally to said heat treatment zone.

6. The heat treatment furnace according to claim 1 wherein the heat shielded enclosure comprises a side wall and first and second end walls, said second end wall being movable relative to the side wall for providing access to the heat treatment zone and for closing off the heat treatment zone.

7. The heat treatment furnace according to claim 6 wherein the orifices are formed in one or both of the side wall and the first end wall of the heat shielded enclosure.

8. A heat treatment furnace having gas cooling or quenching capability comprising:

an outer furnace wall;

a heat shielded enclosure surrounding a heat treatment zone within the outer furnace wall, said enclosure being designed to retain heat within the zone and impede its outward flow therefrom, said enclosure having a plurality of orifices formed therein, said heat shielded enclosure comprising a side wall and first and second end walls, said second end wall being movable relative to the side wall for providing access to the heat treatment zone and for closing off the heat treatment zone;

a plurality of nozzles each in communication with one of said orifices, for injecting a cooling gas into the heat treatment zone, each of said nozzles including a flow control means for impeding unforced flow of heated gas from the heat treatment zone and for allowing forced inflow of a process gas to the heat treatment zone;

a gas exit port disposed in a wall of the heat shielded enclosure, said gas exit port comprising a flow control means for impeding unforced outward flow of the heated gas from the heat treatment zone and for allowing a forced outward flow of a gas from the heat treatment zone; and a plenum extending around the side wall and first end wall of the heat shielded enclosure over the orifices and extending along a path between the outer furnace wall and the heat shielded enclosure to divide the space between the outer furnace wall and the heat shielded enclosure into gas flow paths having opposite directions on opposite sides of the plenum, said gas flow paths including an inner path within said plenum for directing the cooling gas toward and through the orifices in the heat treatment zone and an outer path between said plenum and the outer furnace wall for directing cooling gas exiting the heat treatment zone to a heat exchanger and recirculation means.

9. The heat treatment furnace according to claim 1, wherein the nozzle flow control means comprises a flap moveable by said forced inflow of gas.

10. The heat treatment furnace according to claim 3 wherein the gas exit port comprises an opening formed in the beat shielded enclosure and a panel pivotally mounted in said opening for impeding the unforced outward flow of a gas from the heat treatment zone and for allowing the forced flow of cooling gas from the heat treatment zone.

11. The heat treatment furnace according to claim 3, wherein the exit port flow control means comprises a flap moveable by said forced outward flow of gas.

* * * * *

UNITED STATES PATENT AND TRADEMARK OFFICE

CERTIFICATE OF CORRECTION

PATENT NO. : 6,756,566 B2
APPLICATION NO. : 10/154457
DATED : July 30, 2004
INVENTOR(S) : Craig A. Moller It is certified that error appears in the above-identified patent and that said Letters Patent is hereby corrected as shown below:

Claim 5, Column 7, line 66, "1" should be -- 4 --

Signed and Sealed this

Thirty-first Day of July, 2007

JON W. DUDAS
*Director of the United States Patent and Trademark Office*

UNITED STATES PATENT AND TRADEMARK OFFICE

CERTIFICATE OF CORRECTION

PATENT NO. : 6,756,566 B2
APPLICATION NO. : 10/154457
DATED : July 29, 2004
INVENTOR(S) : Craig A. Moller It is certified that error appears in the above-identified patent and that said Letters Patent is hereby corrected as shown below:

Claim 5, Column 7, line 66, "1" should be -- 4 --

This certificate supersedes Certificate of Correction issued July 31, 2007.

Signed and Sealed this

Twenty-first Day of August, 2007

JON W. DUDAS
*Director of the United States Patent and Trademark Office*

UNITED STATES PATENT AND TRADEMARK OFFICE

CERTIFICATE OF CORRECTION

PATENT NO. : 6,756,566 B2
APPLICATION NO. : 10/154457
DATED : June 29, 2004
INVENTOR(S) : Craig A. Moller It is certified that error appears in the above-identified patent and that said Letters Patent is hereby corrected as shown below:

Claim 5, Column 7, line 66, "1" should be -- 4 --

This certificate supersedes Certificates of Correction issued July 31, 2007 and August 21, 2007.

Signed and Sealed this

Eighteenth Day of September, 2007

JON W. DUDAS
*Director of the United States Patent and Trademark Office*